US010339847B2

(12) United States Patent
Kuo et al.

(10) Patent No.: US 10,339,847 B2
(45) Date of Patent: Jul. 2, 2019

(54) DISPLAY APPARATUS

(71) Applicant: E Ink Holdings Inc., Hsinchu (TW)

(72) Inventors: Wen-Yu Kuo, Hsinchu (TW); Guan-Ru Huang, Hsinchu (TW); Pei-Lin Huang, Hsinchu (TW); Wei-Tsung Chen, Hsinchu (TW)

(73) Assignee: E Ink Holdings Inc., Hsinchu (TW)

( * ) Notice: Subject to any disclaimer, the term of this patent is extended or adjusted under 35 U.S.C. 154(b) by 55 days.

(21) Appl. No.: 15/786,624

(22) Filed: Oct. 18, 2017

(65) Prior Publication Data

US 2018/0204492 A1 Jul. 19, 2018

(30) Foreign Application Priority Data

Jan. 13, 2017 (CN) ..... 2017 1 0025908

(51) Int. Cl.
*G09G 3/00* (2006.01)
*G09G 3/20* (2006.01)

(52) U.S. Cl.
CPC ..... *G09G 3/006* (2013.01); *G09G 3/20* (2013.01); *G09G 3/2018* (2013.01); *G09G 2300/0413* (2013.01); *G09G 2300/08* (2013.01); *G09G 2310/0264* (2013.01); *G09G 2320/029* (2013.01); *G09G 2320/0295* (2013.01)

(58) Field of Classification Search
CPC ..... G09G 3/006; G09G 2320/029; G09G 2300/0413
See application file for complete search history.

(56) References Cited

U.S. PATENT DOCUMENTS 7,015,966 B1 3/2006 Lin
7,277,128 B2 10/2007 Miyahara
7,277,185 B2 10/2007 Monshouwer et al.
2002/0145580 A1 10/2002 Waterman
2006/0202923 A1* 9/2006 Osada ..... G09G 3/006 345/76
2007/0075936 A1* 4/2007 Kim ..... G09G 3/006 345/76
2013/0293526 A1* 11/2013 Igawa ..... G09G 3/3696 345/212
2014/0183481 A1* 7/2014 Lee ..... H01L 27/3213 257/40
2015/0091883 A1* 4/2015 Pyun ..... G09G 3/2074 345/204
2015/0116307 A1* 4/2015 Kim ..... G09G 3/3688 345/213
2015/0170562 A1 6/2015 In et al.
2015/0192634 A1* 7/2015 Lewis ..... G01R 31/2621 324/762.09
2015/0243229 A1 8/2015 Jung et al.
(Continued)

FOREIGN PATENT DOCUMENTS

CN 105874526 8/2016

*Primary Examiner* — Dong Hui Liang
(74) *Attorney, Agent, or Firm* — JCIPRNET

(57) ABSTRACT

A display apparatus including a display panel and a driver circuit is provided. The display panel includes a display region and a non-display region. The non-display region includes a plurality of dummy pixels connected to one another. The driver circuit provides gate driving voltages and a test data voltage, so as to make the dummy pixels connected to one another generate a charging rate test signal in response to the test data voltage.

10 Claims, 4 Drawing Sheets

(56) References Cited

U.S. PATENT DOCUMENTS

| | | | | |
|---|---|---|---|---|
| 2016/0019824 | A1* | 1/2016 | Choi | G09G 3/3666 345/694 |
| 2016/0035281 | A1* | 2/2016 | Jeon | G09G 3/3225 345/690 |
| 2016/0189644 | A1* | 6/2016 | So | G09G 3/3233 345/205 |
| 2016/0321971 | A1* | 11/2016 | Chai | G09G 3/20 |
| 2018/0122302 | A1* | 5/2018 | Koong | G09G 3/3258 |

* cited by examiner

DISPLAY APPARATUS

CROSS-REFERENCE TO RELATED APPLICATION

This application claims the priority benefit of China application serial no. 201710025908.1, filed on Jan. 13, 2017. The entirety of the above-mentioned patent application is hereby incorporated by reference herein and made a part of this specification.

BACKGROUND OF THE INVENTION

Field of the Invention

The invention relates to a display apparatus and particularly relates to a display apparatus for measuring a voltage charging rate of pixels.

Description of Related Art

An image of a general thin display is formed by displaying a plurality of pixels in different gray levels. In general, a gate driving signal on a gate line determines the time that the pixels receives data voltages, and a data line transmits the data voltages to the pixels so as to charge the pixels to show gray levels corresponding to the display data. Therefore, the charging rate of the pixels closely relates to the display quality of the display. If the charging rate of the pixels is too slow, the display data may not be correctly written in the pixels. That is, the pixels are unable to display the correct image.

In the stage of manufacturing a panel, to know whether a simulation result of the charging rate of the panel pixels matches the actual charging rate, a measurement of the pixel charging rate needs to be performed. When the pixels are driven, the individual pixels have small voltage variation, which cannot be effectively measured by a general voltage measuring apparatus. Thus, how to perform measurement of the pixel charging rate has become an issue.

SUMMARY OF THE INVENTION

The invention provides a display apparatus that measures a pixel charging rate easily and effectively.

The display apparatus of the invention includes a display panel and a driver circuit. The display panel includes a plurality of gate lines and a plurality of data lines, and the display panel has a display region and a non-display region. The non-display region includes a plurality of dummy pixels disposed at a region formed by corresponding gate lines and corresponding data lines that intersect one another, and at least a part of the dummy pixels are connected to one another. The driver circuit coupled to the display panel provides a gate driving voltage to the gate lines corresponding to the dummy pixels, and provides a test data voltage to the corresponding data lines, such that the dummy pixels connected to one another generate a charging rate test signal in response to the test data voltage.

In an embodiment of the invention, the driver circuit provides the gate driving voltage and the test data voltage during a test period.

In an embodiment of the invention, the display region includes a plurality of display pixels disposed at the region formed by the gate lines and data lines that intersect one another, and the driver circuit sequentially drives the gate lines during a frame period and provides the test data voltage to the data lines.

In an embodiment of the invention, a resolution of the display apparatus is defined by the gate lines and the data lines corresponding to the dummy pixels and the display pixels.

In an embodiment of the invention, the display apparatus further includes an amplifying circuit. An input end thereof is coupled to at least one of the dummy pixels connected to one another, an output end of the amplifying circuit is coupled to a test contact point, and the amplifying circuit amplifies the charging rate test signal to generate an amplified test signal at the test contact point.

In an embodiment of the invention, the amplifying circuit includes an operational amplifier. A positive input end thereof receives the charging rate test signal, and a negative input end and an output end of the operational amplifier are coupled to each other.

In an embodiment of the invention, the amplifying circuit is integrated in the display panel.

In an embodiment of the invention, one of the dummy pixels connected to one another has a test contact point, and the dummy pixels connected to one another output the charging rate test signal via the test contact point.

In an embodiment of the invention, the test data voltage drives the dummy pixel to display a minimum value of gray level.

In an embodiment of the invention, the test data voltage is 15 volts.

Based on the above, in the exemplary embodiments of the invention, the dummy pixels in the non-display region are connected to one another, and the gate driving voltages and the test data voltage are provided to the dummy pixels connected to one another, such that the dummy pixels connected to one another provide the charging rate test signal providing a sufficiently large voltage value in response to the test data voltage. Thereby, measurement of the pixel charging rate is performed easily and effectively.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain the principles of the invention.

DESCRIPTION OF THE EMBODIMENTS

Figure 1:
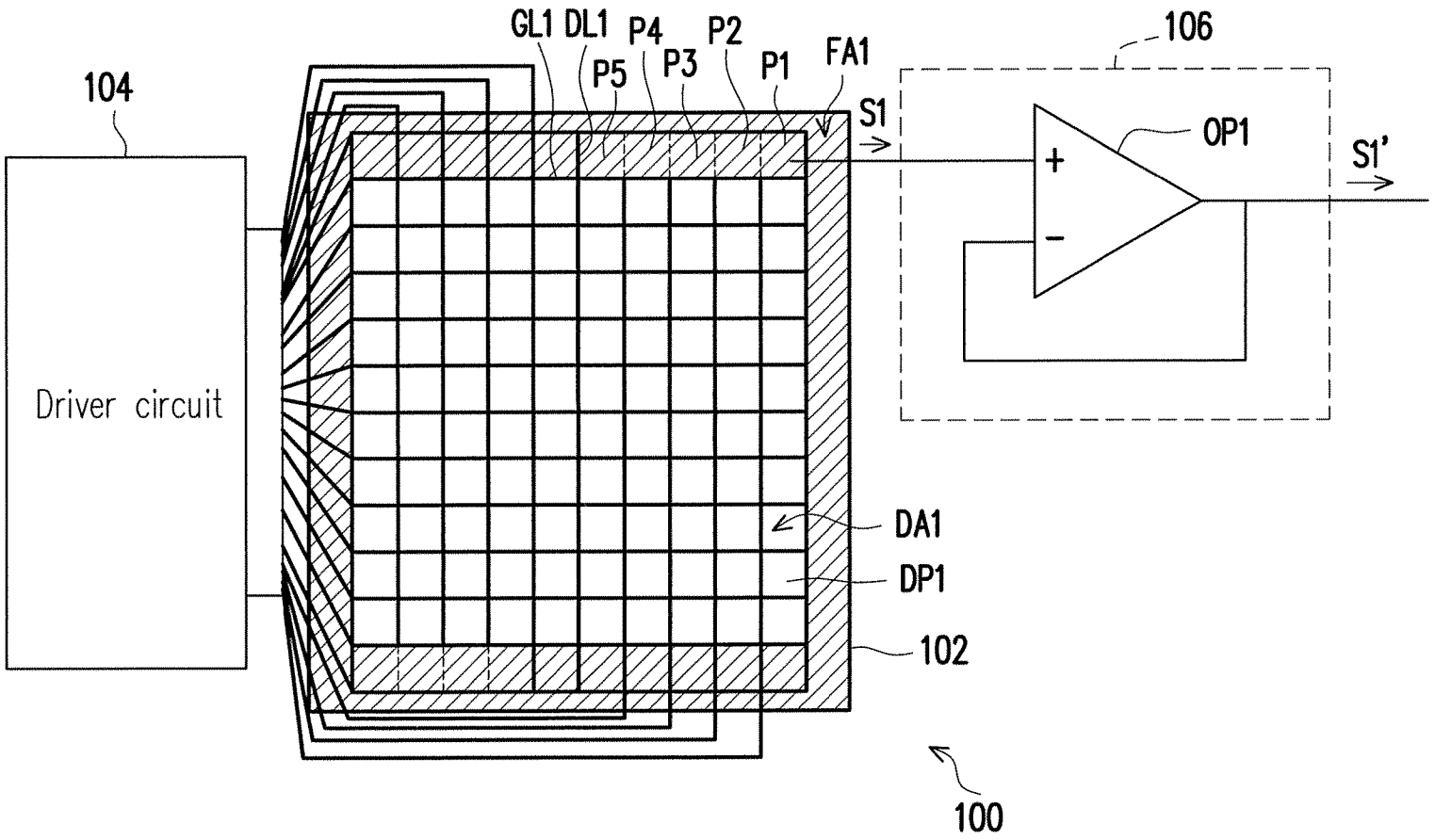
FIG. 1 shows a schematic view of a display apparatus according to an embodiment of the invention.

FIG. 1 shows a schematic view of a display apparatus according to an embodiment of the invention. Referring to FIG. 1, a display apparatus 100 includes a display panel 102 and a driver circuit 104. The driver circuit 104 is coupled to the display panel 102. The display panel 102 is a hard display panel or a soft display panel, e.g., an a-Si TFT display panel, an OTFT display panel, an OLED display panel, and so on. The display panel 102 includes a plurality of gate lines GL1, a plurality of data lines DL1, a plurality of dummy pixels (for example, P1 to P5) and a plurality of display pixels DP1. The display panel 102 has a display region DA1 and a non-display region FA1 (the hatched region as shown in FIG. 1). The dummy pixels are located in the non-display region FA1 and are disposed respectively at intersections of the corresponding gate lines GL1 and the data lines DL1 to be connected to the corresponding gate lines GL1 and the corresponding data lines DL1. To keep the drawing simple and easily understandable, FIG. 1 merely marks the five dummy pixels P1 to P5 and one display pixel DP1, and does not mark the other dummy pixels and display pixels. In addition, it should be noted that the number of the dummy pixels and the number of the display pixels DP1 are not limited to the embodiment of FIG. 1.

In this embodiment, the dummy pixels P1 to P5 are connected to one another to form a dummy pixel string (for example, connected via a pixel electrode. In FIG. 1, the dotted line separating two dummy pixels indicates that the two dummy pixels are connected to each other. For example, the dummy pixels P1 and P2 are connected to each other). The driver circuit 104 provides gate driving voltages and a test data voltage to the gate lines GL1 and the data lines DL1, so as to make the dummy pixels P1 to P5 connected to one another generate a charging rate test signal S1 in response to the test data voltage. Since the dummy pixels in a general display panel are not involved in display, the gate driving voltages of the dummy pixels P1 to P5 are provided additionally. For example, the gate driving voltages may be provided by using a surplus output pin on the driver circuit 104 (e.g., a diver chip). In addition, the test data voltage may be used to drive the dummy pixels to display a minimum value of gray level (e.g., black), and in several embodiments, may be used to display a maximum value of gray level or a specific gray level. A voltage value of the test data voltage is, for example, 15 volts, but not limited thereto. Further, one of the dummy pixels P1 to P5 connected to one another has a test contact point (in this embodiment, the test contact point is, for example, a pixel electrode of the dummy pixel P1, but not limited thereto), and the dummy pixels P1 to P5 connected to one another output the charging rate test signal S1 via the test contact point.

The charging rate test signal S1 reflects the rate that the dummy pixels P1 to P5 are charged by the test data voltage, for example, according to whether the voltages of the dummy pixels P1 to P5 are increased to a preset voltage within a preset period after the dummy pixels P1 to P5 receive the test data voltage. If so, it indicates that the charging rate of the dummy pixels P1 to P5 meets the requirement. Since the manufacturing process and structure of the dummy pixels P1 to P5 are the same as those of the display pixel DP1, the dummy pixels P1 to P5 have the same charging characteristic as the display pixel DP1. As the charging rate of the dummy pixels P1 to P5 meets the requirement, the charging rate of the display pixel DP1 also meets the requirement, so that an image corresponding to the data is correctly displayed.

Since the charging rate test signal S1 is provided by the dummy pixels P1 to P5 that are connected in series, the voltage value and voltage variation of the charging rate test signal S1 are obviously greater than the voltage value and voltage variation provided by a single dummy pixel. Thus, the issue that the voltage to be tested may be too small to be measured by a voltage measuring apparatus is solved, and an average voltage variation value of a single dummy pixel may be obtained by dividing the measurement result by the number of the series-connected dummy pixels.

In several embodiments, if the voltage value of the charging rate test signal S1 is to be further increased, an amplifying circuit 106 coupled to the test contact point may amplify the charging rate test signal S1 to generate an amplified test signal S1', which is then output to the voltage measuring apparatus, e.g., an oscilloscope, to facilitate determining the charging rate of the dummy pixels P1 to P5. The amplifying circuit 106 is embodied, for example, by an operational amplifier OP1. As shown in FIG. 1, a positive input end of the operational amplifier OP1 is coupled to the test contact point on the dummy pixel P1, and a negative input end is coupled to an output end of the operational amplifier OP1. It should be noted that in several embodiments, the amplifying circuit 106 may also be integrated in the display panel. The input end of the amplifying circuit 106 may be, for example, coupled to the dummy pixel P1, and the output end is used as the test contact point to facilitate connection with the voltage measuring apparatus.

Figure 2:
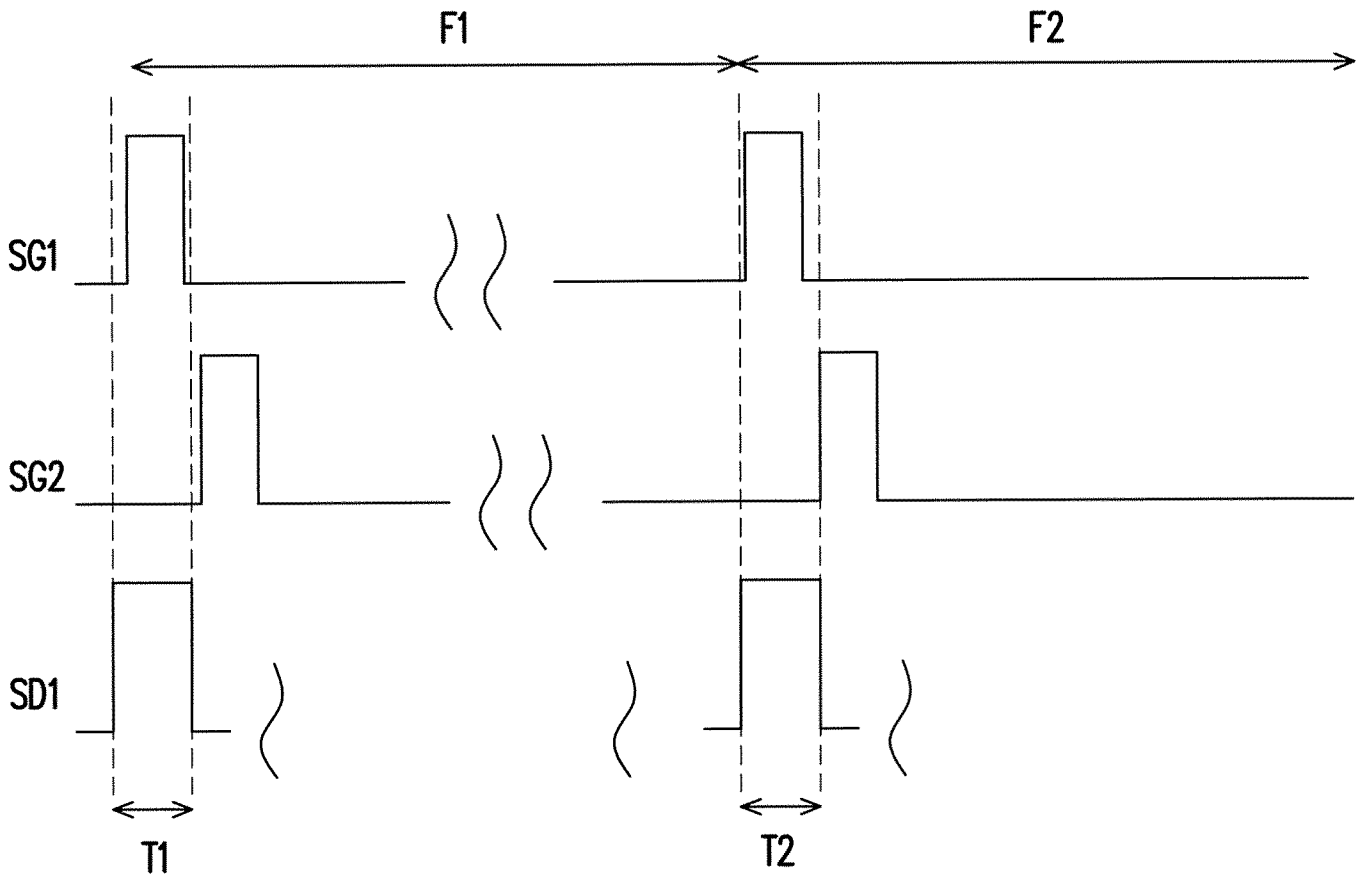
FIG. 2 shows a schematic view of waveforms of gate driving voltages and a test data voltage of the display apparatus according to the embodiment of FIG. 1.

It should be noted that the driver circuit 104 may be operated during a specific test period. FIG. 2 shows a schematic view of waveforms of the gate driving voltages and the test data voltage of the display apparatus according to the embodiment of FIG. 1. The gate driving voltage SG1 is a voltage on the gate lines corresponding to the dummy pixels P1 to P5, and the gate driving voltage SG2 is a voltage on the gate lines corresponding to the display pixels adjacent to the dummy pixels P1 to P5. To keep the drawing simple, the gate driving voltages on the other gate lines are not further illustrated here. Moreover, a test data voltage SD1 is a voltage on the data line DLL As shown in FIG. 2, the driver circuit 104 increases the voltage levels of the gate driving voltage SG1 and the test data voltage SD1 merely during a test period T1 in a frame period F1, so as to test the charging rate of the dummy pixels P1 to P5. Similarly, the charging rate of the dummy pixels P1 to P5 is tested merely during a test period T2 in a frame period F2.

Figure 3:
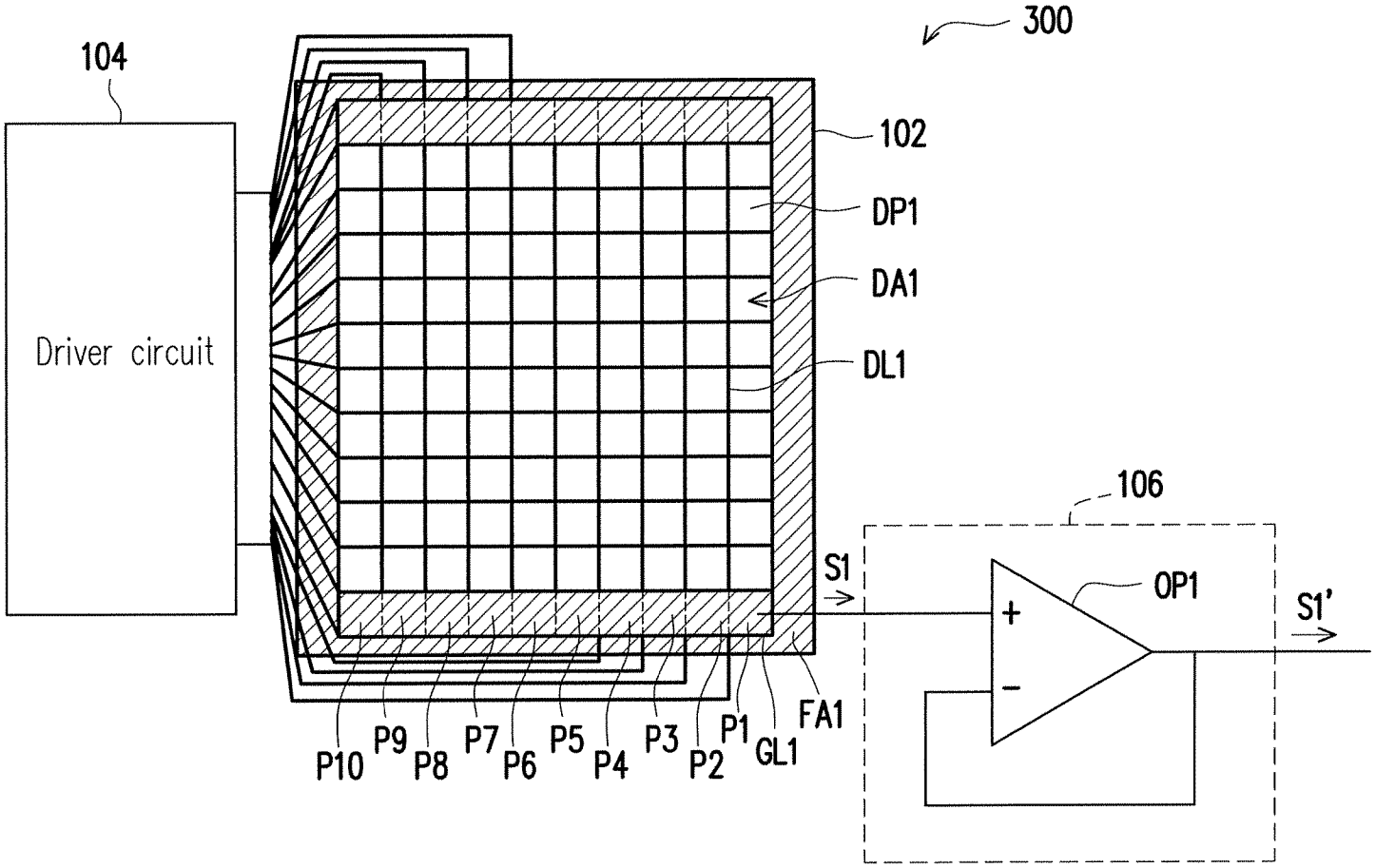
FIG. 3 shows a schematic view of a display apparatus according to another embodiment of the invention.

FIG. 3 shows a schematic view of a display apparatus 300 according to another embodiment of the invention. A difference between this embodiment and the embodiment of FIG. 1 lies in that: in the embodiment of FIG. 1, only a part of the dummy pixels (P1 to P5) are connected in series; however, in this embodiment, all the dummy pixels (P1 to P10) in the non-display region FA1 are connected in series. That is, the number of the series-connected dummy pixels is not limited to the embodiment of FIG. 1 or this embodiment. As the number of the series-connected dummy pixels increases, the voltage value and the voltage variation of the charging rate test signal S1 are greater, which is easy for the voltage measuring apparatus to carry out the measurement. In addition, in several embodiments, a resolution of the display panel 102 is designed to be determined by the dummy pixels and the display pixel DP1. For instance, it is assumed that the original resolution of the display panel 102 is 1024×786. If the dummy pixels correspond to two gate lines, the display panel 102 may be designed as a panel with 1024×788 resolution. That is, instead of using the remaining output pins on the driver circuit 104 to drive the dummy pixels, the driver circuit 104 is directly designed as a circuit responsible for driving 788 gate lines without using a reserved pin of the driver circuit 104. Likewise, in this embodiment, the charging rate test signal S1 is also outputted via the test contact point on the dummy pixel P1, and the charging rate test signal S1 may also be amplified by the amplifying circuit 106 as the embodiment of FIG. 1. Details thereof are not repeated here.

Figure 4:
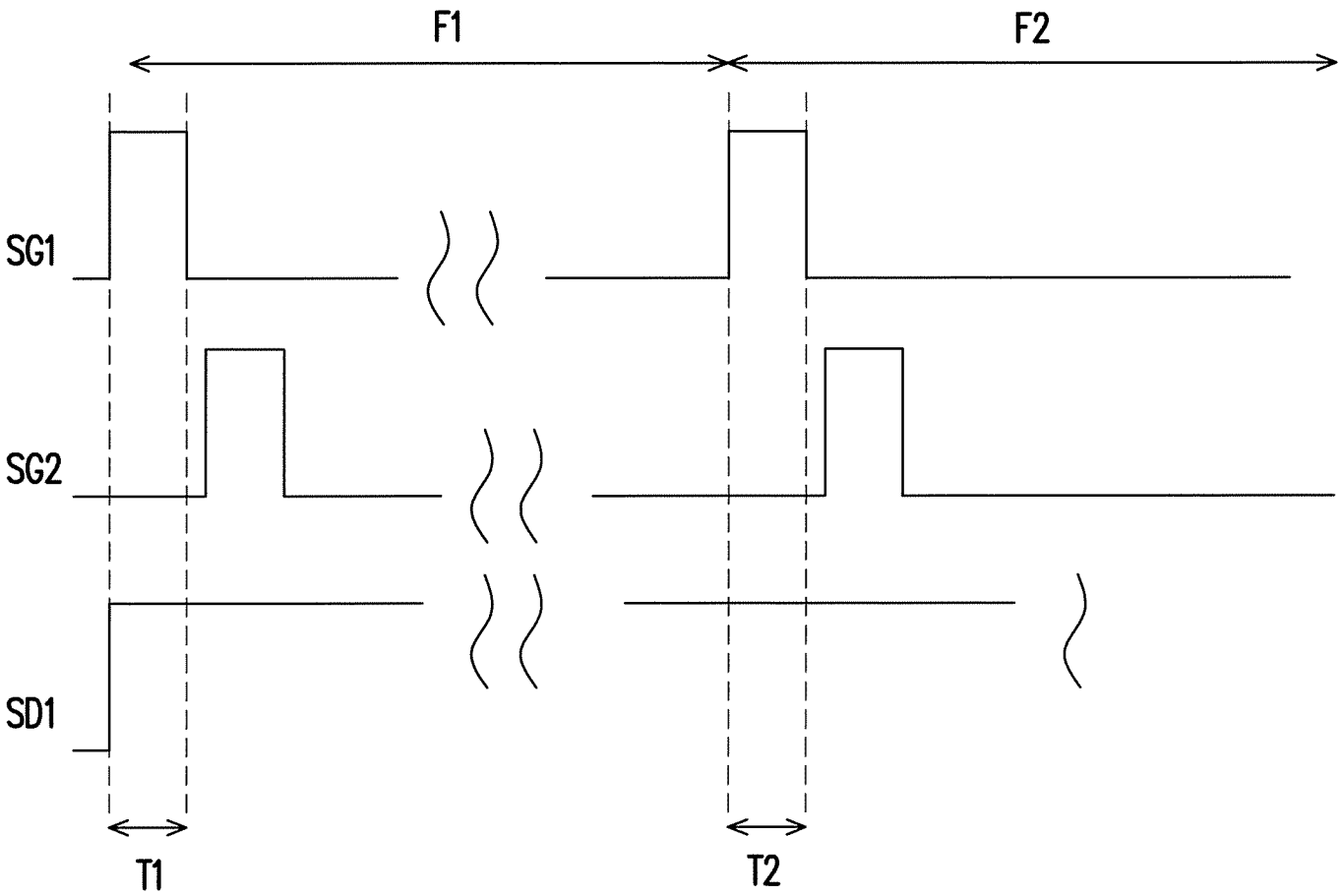
FIG. 4 shows a schematic view of waveforms of the gate driving voltages and the test data voltage of the display apparatus according to the embodiment of FIG. 3.

FIG. 4 shows a schematic view of waveforms of the gate driving voltages and the test data voltage of the display apparatus according to the embodiment of FIG. 3. In this embodiment, in the frame periods F1 and F2, the driver circuit 104 sequentially drives the gate lines of the dummy pixels and the display pixels DP1 while maintaining the test data voltage SD1 at a high voltage level, so as to make the driving dummy pixels and the display pixels both display an image in minimal gray level. The test data voltage SD1 is not only maintained at a high voltage level in the test periods T1 and T2 as shown in FIG. 2.

To sum up, in the exemplary embodiments of the invention, the dummy pixels in the non-display region are connected to one another, and the gate driving voltages and the test data voltage are provided to the dummy pixels connected to one another by the driver circuit, such that the dummy pixels connected to one another provide the charging rate test signal providing a sufficiently large voltage value in response to the test data voltage. Thereby, measurement of the pixel charging rate is performed easily and effectively.

It will be apparent to those skilled in the art that various modifications and variations can be made to the disclosed embodiments without departing from the scope or spirit of this invention. In view of the foregoing, it is intended that the invention covers modifications and variations provided that they fall within the scope of the following claims and their equivalents.

What is claimed is:

1. A display apparatus, comprising:

a display panel comprising a plurality of gate lines and a plurality of data lines, the display panel having a display region and a non-display region, the non-display region comprising:

a plurality of dummy pixels disposed at a region formed by corresponding gate lines and corresponding data lines intersecting one another, a part of the dummy pixels being connected to one another; and a driver circuit coupled to the display panel, and providing a gate driving voltage to the gate lines corresponding to the dummy pixels and providing a test data voltage to the corresponding data lines, such that the dummy pixels connected to one another generate a charging rate test signal in response to the test data voltage.

2. The display apparatus according to claim 1, further comprising:

an amplifying circuit, wherein an input end of the amplifying circuit is coupled to at least one of the dummy pixels connected to one another, an output end of the amplifying circuit is coupled to a test contact point, and the amplifying circuit amplifies the charging rate test signal to generate an amplified test signal at the test contact point.

3. The display apparatus according to claim 2, wherein the amplifying circuit comprises:

an operational amplifier, wherein a positive input end of the operational amplifier receives the charging rate test signal, and a negative input end and an output end of the operational amplifier are coupled to each other.

4. The display apparatus according to claim 2, wherein the amplifying circuit is integrated in the display panel.

5. The display apparatus according to claim 1, wherein the display region comprises:

a plurality of display pixels disposed at the region formed by the gate lines and the data lines intersecting one another, wherein the driver circuit sequentially drives the gate lines during a frame period and provides a test data voltage to the data lines.

6. The display apparatus according to claim 5, wherein a resolution of the display apparatus is defined by the gate lines and the data lines corresponding to the dummy pixels and the display pixels.

7. The display apparatus according to claim 1, wherein the driver circuit provides the gate driving voltage and the test data voltage during a test period.

8. The display apparatus according to claim 1, wherein one of the dummy pixels connected to one another has a test contact point, and the dummy pixels connected to one another output the charging rate test signal via the test contact point.

9. The display apparatus according to claim 1, wherein the test data voltage drives the dummy pixels to display a minimum value of gray level.

10. The display apparatus according to claim 1, wherein the test data voltage is 15 volts.

* * * * *